United States Patent [19]

Hakner

[11] 4,144,866

[45] Mar. 20, 1979

[54] INTERNAL COMBUSTION ROTARY ENGINE

[76] Inventor: Robert Hakner, 2050 21st Dr., Brooklyn, N.Y. 11214

[21] Appl. No.: 851,485

[22] Filed: Nov. 14, 1977

[51] Int. Cl.[2] ..... F02B 53/00

[52] U.S. Cl. ..... 123/241; 123/216; 418/122; 418/186; 418/270

[58] Field of Search ..... 123/241, 216; 418/122, 418/270, 186

[56] References Cited

U.S. PATENT DOCUMENTS

| | | | |
|---|---|---|---|
| 3,289,654 | 12/1966 | Geiger | 123/241 |
| 3,349,757 | 10/1967 | Artajo | 418/270 |
| 3,387,596 | 6/1968 | Niemand | 123/241 X |
| 3,442,257 | 5/1969 | Walker | 123/241 |
| 3,950,174 | 4/1976 | Artajo | 123/241 X |

FOREIGN PATENT DOCUMENTS

| | | | |
|---|---|---|---|
| 1551115 | 6/1970 | Fed. Rep. of Germany | 123/241 |
| 1936273 | 1/1971 | Fed. Rep. of Germany | 123/241 |
| 2047732 | 3/1972 | Fed. Rep. of Germany | 123/241 |

*Primary Examiner*—Carlton R. Croyle
*Assistant Examiner*—Michael Koczo, Jr.
*Attorney, Agent, or Firm*—Kenyon & Kenyon, Reilly, Carr & Chapin

[57] ABSTRACT

The disclosure is directed to a rotary engine having an annular housing and a plurality of walls disposed around the interior of the housing with adjacent walls joined by rounded corners. A plurality of sliding pistons are disposed within the interior of the housing spaced apart from one another and connected radially to a drive shaft extending through the interior of the housing along the central axis thereof. The sliding pistons having face portions adapted to slide adjacent the inner surfaces of the walls are disposed radially outward of the drive shaft. End plates disposed at opposite sides of the housing and intersecting the central axis thereof enclose the opposite sides of each sliding piston which extend to adjacent the inner surfaces thereof. The sliding pistons are guided around the plurality of walls and rounded corners of the housing chamber by cams attached to the end plates. As a sliding piston moves adjacent each rounded corner disposed between adjacent walls, a chamber is progressively formed between the face of the piston, the inner surface of the rounded corner and the end plates and then progressively eliminated as the charge is compressed. Thereafter, the compressed charge can be ignited by spark ignition or by compression ignition. Intake of an air charge as well as expansion of a compressed charge after combustion occur in the corner chambers so formed. Ports in the end plates are sequentially connected to passages extending from the sides of each piston to the face of the piston to provide a flow path with respect to each of the chambers formed between the face of the piston and a rounded corner. The ports enable the sliding pistons to control the delivery of charges and the removal of exhaust gas with respect to the chambers.

34 Claims, 21 Drawing Figures

Fig. 7.
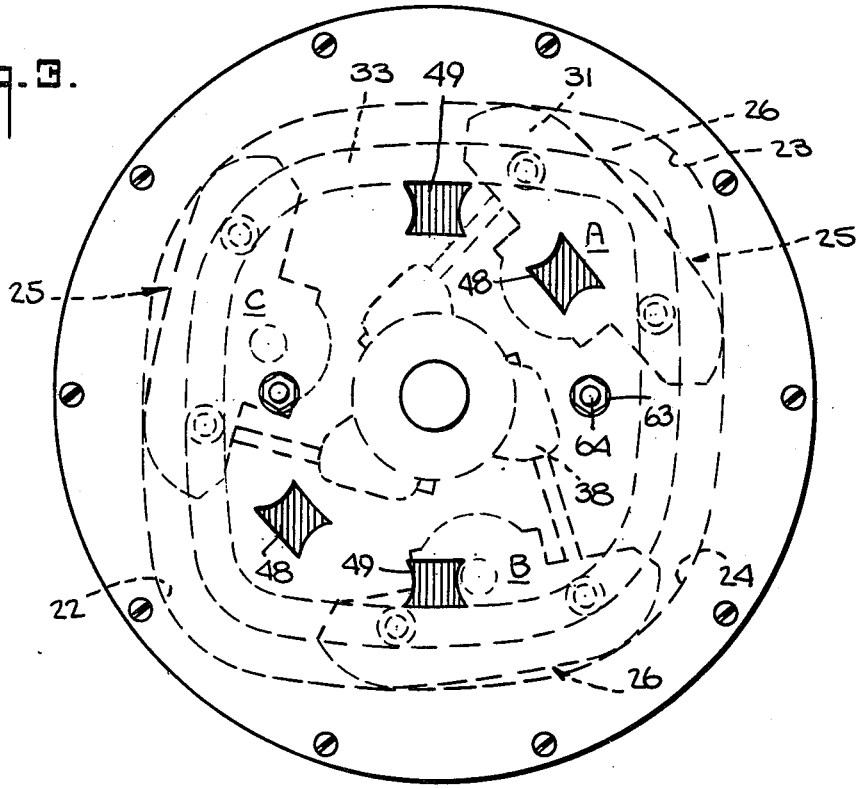
Fig. 8.
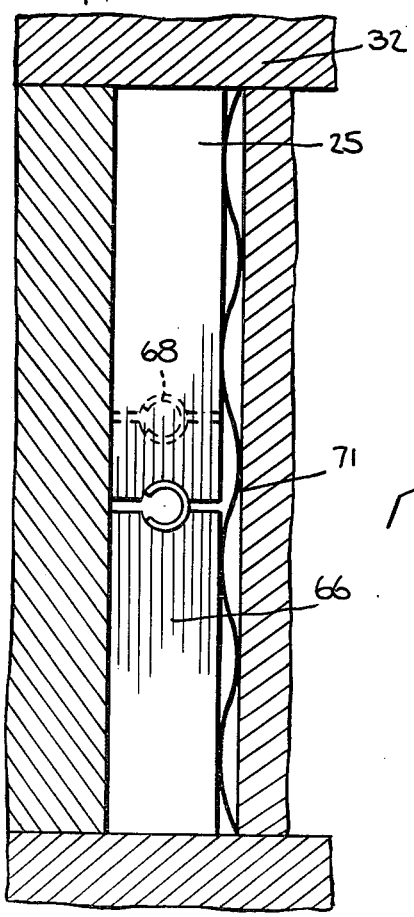
Fig. 9.
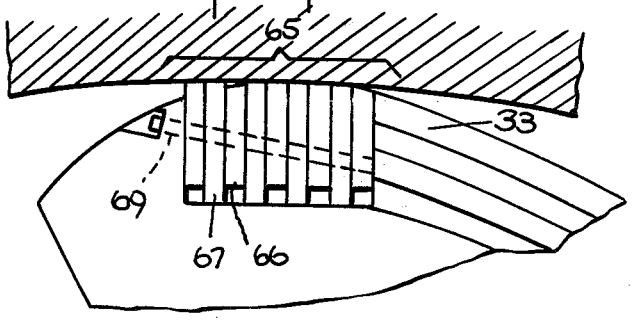
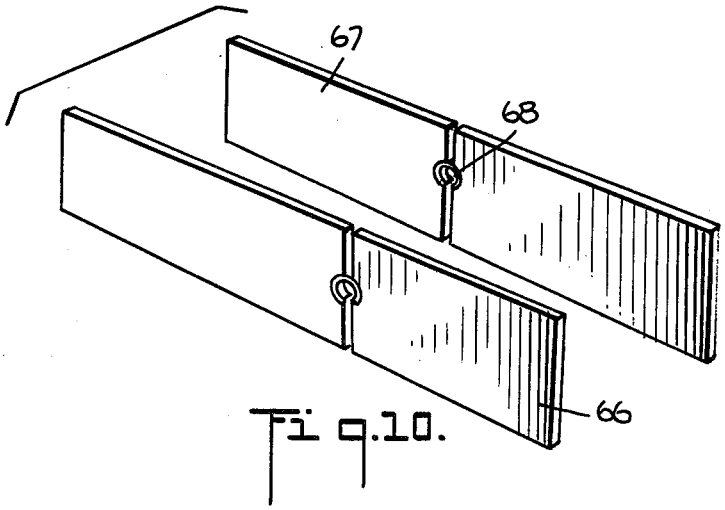
Fig. 10.

20
21
22
23
24
25
26
27
28
29
30
30a
31
31a
37
37a
38
39
40
41
51
51a
A
B
C
5
8

Fig. 12.
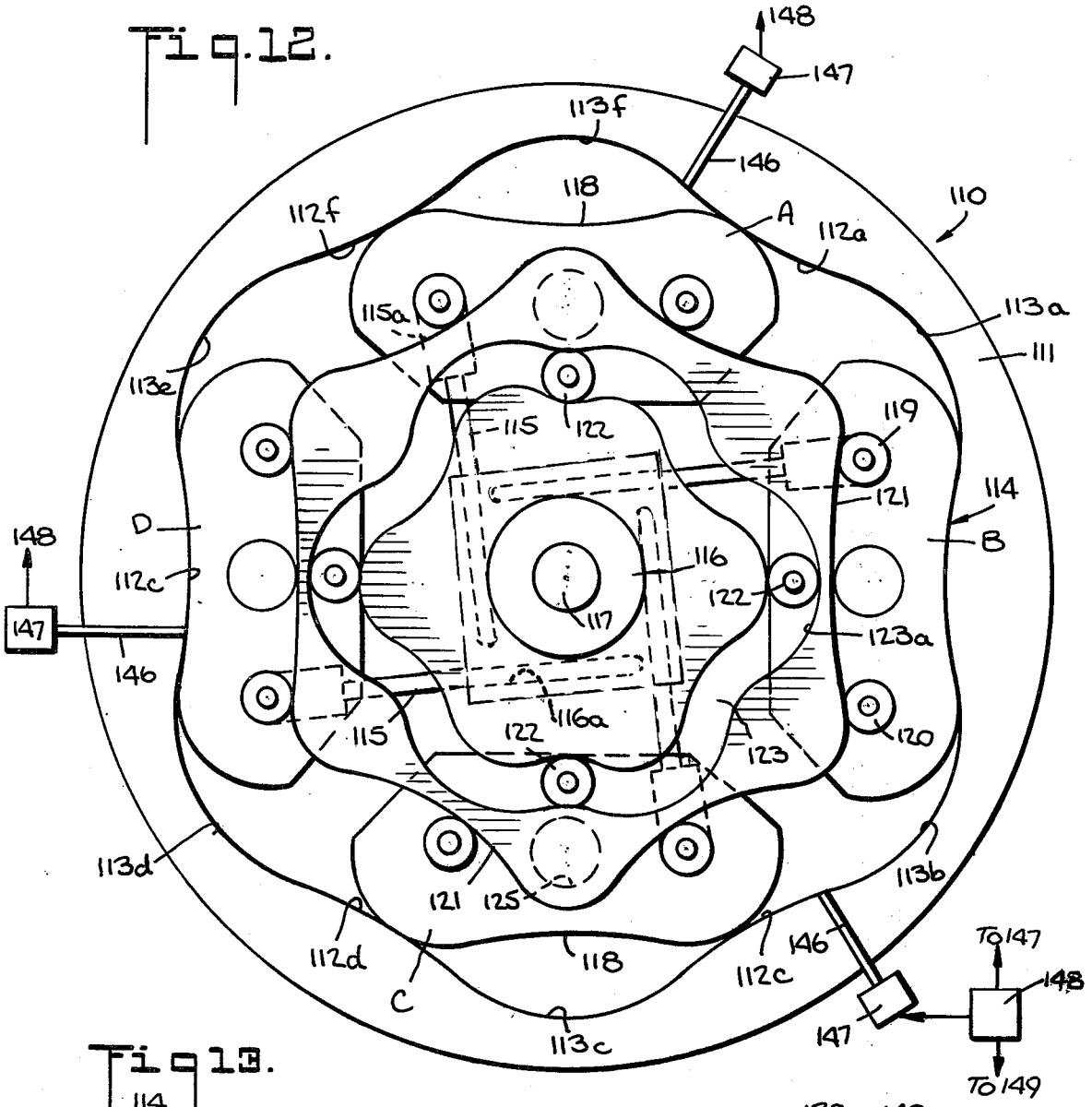
Fig. 13.
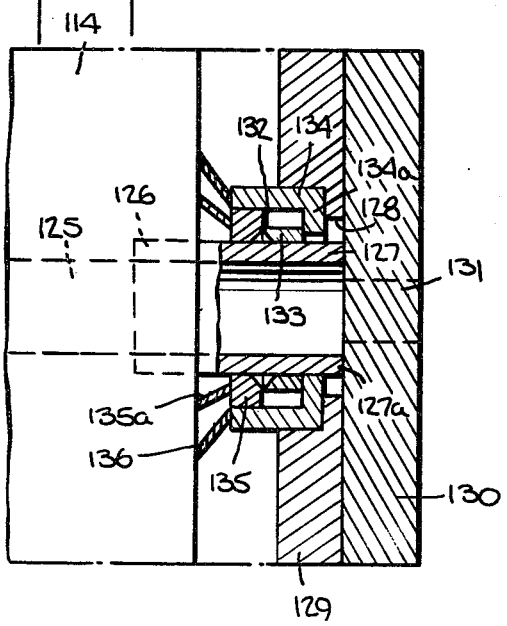
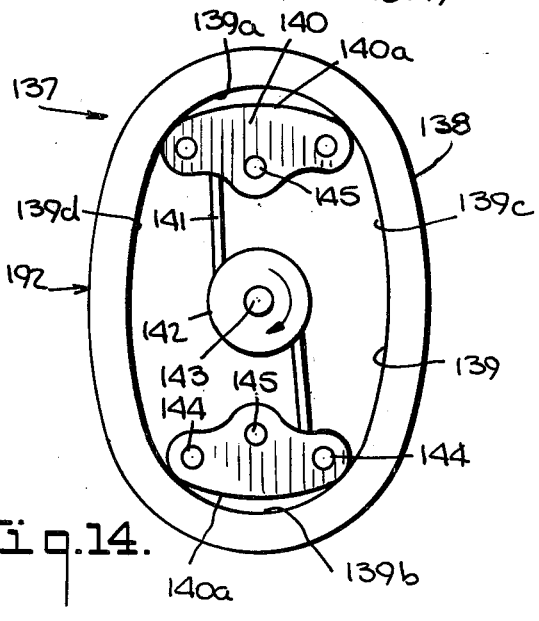
Fig. 14.

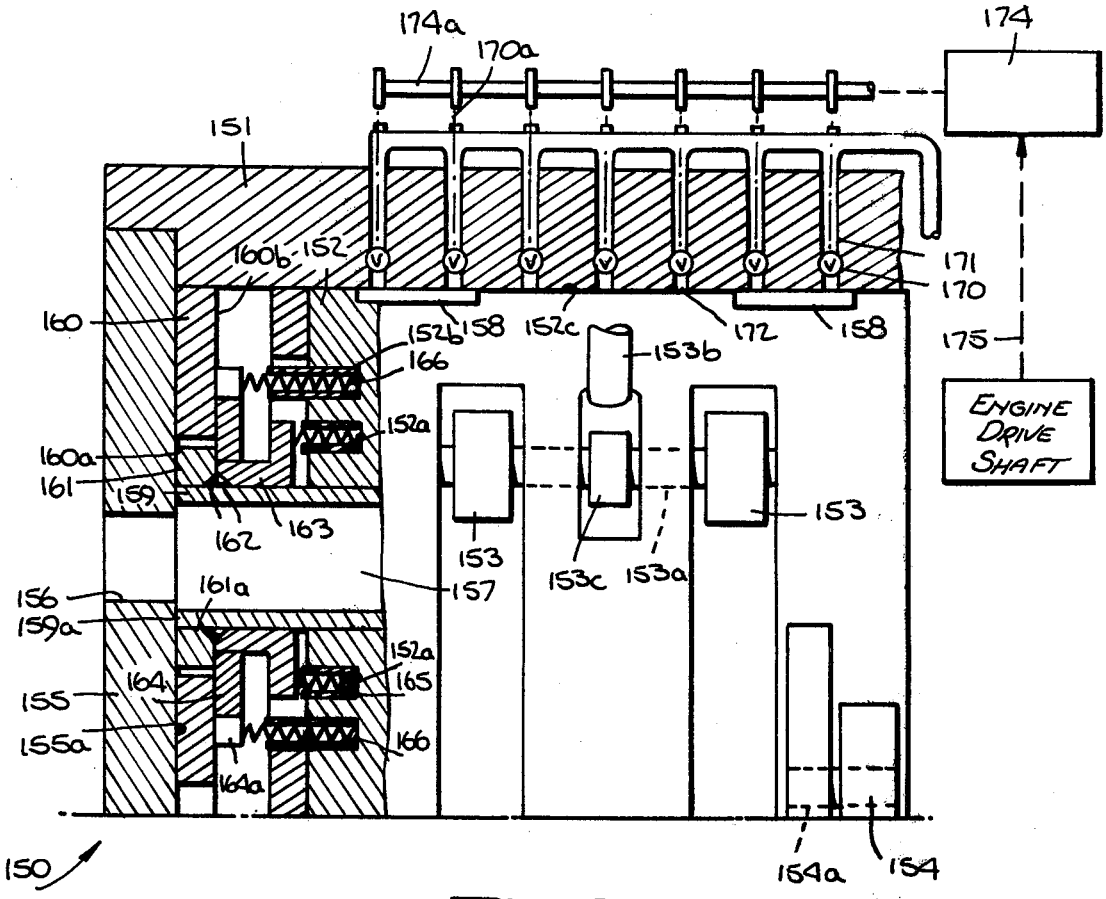
Fig.15.
Fig.16.
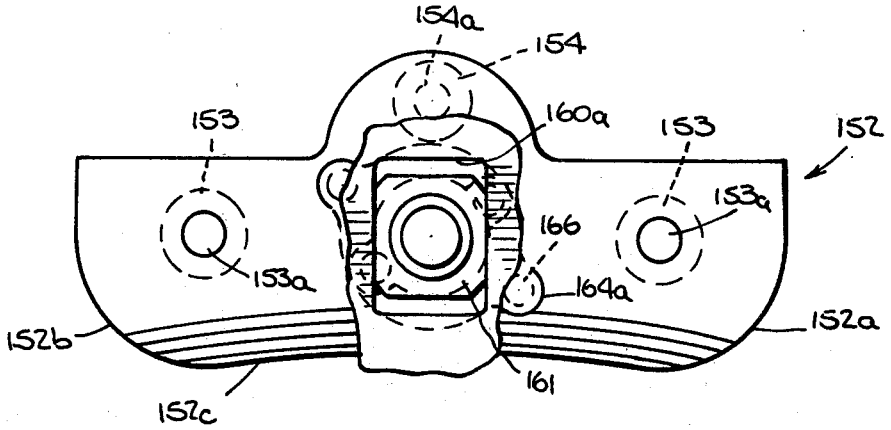

INTERNAL COMBUSTION ROTARY ENGINE

BACKGROUND OF THE INVENTION

The invention relates to the field of rotary piston fluid flow devices in which fluid flow is caused to occur with respect to the device in response to the positive displacement pumping action of a plurality of pistons which move along a rotary path within the device. More in particular, the invention relates to a rotary piston internal combustion engine in which a charge compressed by a rotary piston is ignited to provide pressured products of combustion. The products of combustion are expanded, thereby providing a driving force to the piston. The connecting of the rotary piston to a drive shaft within the engine causes the rotary piston to apply torque to the drive shaft, thereby driving it in rotation. The rotary piston internal combustion engine of the invention has an operating cycle similar to that of a reciprocating piston engine and includes the events of intake, compression, combustion followed by expansion, and exhaust.

SUMMARY OF THE INVENTION

The invention is directed to a rotary piston fluid flow device and more in particular to an internal combustion rotary piston engine. The engine comprises an annular-shaped housing having a plurality of inner walls and a plurality of rotary sliding pistons which have face portions that move adjacent the inner walls of the housing. The inner walls of the housing are joined by rounded corner portions. The opposite sides of the housing adjacent the inner walls are covered by end plates. Chambers are sequentially formed between the faces of the pistons, the rounded corners, and the end plates. The rotary movement of the sliding pistons is controlled by cams and cam tracks. Each of the sliding pistons is connected to a drive shaft by a connecting rod which is in telescoping engagement with the drive shaft. The invention also includes the use of a rotating valve porting arrangement. The porting arrangement directs the flow of charges and exhaust with respect to passages in the sliding pistons and the chambers formed by the sliding pistons and the rounded corners. The progressive forming of an intake chamber by a piston adjacent a rounded corner causes a charge to pass through the passages of a piston. Upon further movement of the piston, the intake chamber is eliminated as the charge is compressed. Combustion of the fuel-air charge within the passages of the piston is then initiated by spark ignition or compression ignition. Thereafter, the piston forms an expansion chamber with a rounded corner in which the pressured products of combustion are expanded. The expanding products apply a pressure force to the face of the piston. The pressure force in conjunction with the control of the pistons by the cams and cam tracks causes the piston to move in a rotary manner within the annular-shaped housing.

Accordingly, an object of the invention is to provide a rotary piston internal combustion engine having sliding pistons which sequentially form chambers with the rounded corners of the annular-shaped housing.

Another object of the invention is to provide a rotary piston engine in which the sliding pistons control the flow of intake charges and exhaust gas by passages in the pistons which are sequentially connected to stationary ports.

Still another object of the invention is to provide a rotary piston engine in which the combustion process can be carried out in a substantially constant volume formed by the internal passages within the sliding piston.

An additional object of the invention is to provide a rotary piston engine which can efficiently convert the expansion of the products of combustion into usable torque by means of cams and cam tracks which control the rotary motion of the sliding pistons.

A further object of the invention is to increase the portion of the cycle during which expansion of the products of combustion occurs as compared to the portion of the cycle during which combustion occurs.

Still a further object of the invention is to maintain the combustion temperature at a predetermined intermediate level while increasing the pressure of combustion by injecting heat expandable fluid into the products of combustion.

These and other objects of the invention will appear from the following description of a preferred embodiment of the invention to be read in conjunction with the accompanying drawings wherein like components depicted in the same embodiment in different views are designated by the same reference numerals.

BRIEF DESCRIPTION OF THE DRAWINGS

FIG. 3 is a side elevational view of the engine showing the positioning of the sliding pistons, ports and drive shaft;

FIG. 8 is a fragmentary enlarged section view taken along line 8—8 in FIG. 4 and showing the face seal construction for a sliding piston;

FIG. 9 is a fragmentary side elevational view showing a side portion of a sliding piston and its seals;

FIG. 10 is an exploded perspective view of the construction of the sliding piston seals;

FIG. 12 is a vertical section view of another embodiment of the invention showing the positioning of four sliding pistons and the cam configuration of an engine, having six corner portions;

FIG. 13 is a fragmentary vertical section view of another embodiment of the sealing means for the passages of the sliding piston;

FIG. 14 is a schematic view of another embodiment of the invention having two sliding pistons and the internal configuration of the main engine housing for stationary-type engines and for engines operating with slow-burning fuels such as powdered coal.

FIG. 15 is a fragmentary section of an engine showing another embodiment of a sealing arrangement for a flow passage of a piston and an embodiment of a valve construction for delivering an expandable fluid to the interior of the housing; and FIG. 16 is a section view taken along the line 16—16 in FIG. 15 and showing the sealing arrangement for a flow passage of a piston.

DESCRIPTION OF THE PREFERRED EMBODIMENTS

As shown in FIGS. 1, 2, 3 and 4, the rotary piston fluid flow device or engine 20 of the invention comprises annular housing 21 having a plurality of internal walls 22. By way of example, walls 22 can be disposed substantially in the form of a rectangle where four walls are employed. Each adjacent pair of walls 22 intersect at junctions or rounded corners 23 and 24, respectively. The walls can be disposed in other forms such as that of an oval or a polygon including for example, four or more walls.

Increasing the number of walls beyond four, increases the angle between adjacent walls and causes the rounded corners to be of an increased radius of curvature. In the case of three walls, the angle between adjacent walls is an acute angle. An oval configuration may also be provided as shown in FIG. 14.

Figure 4:
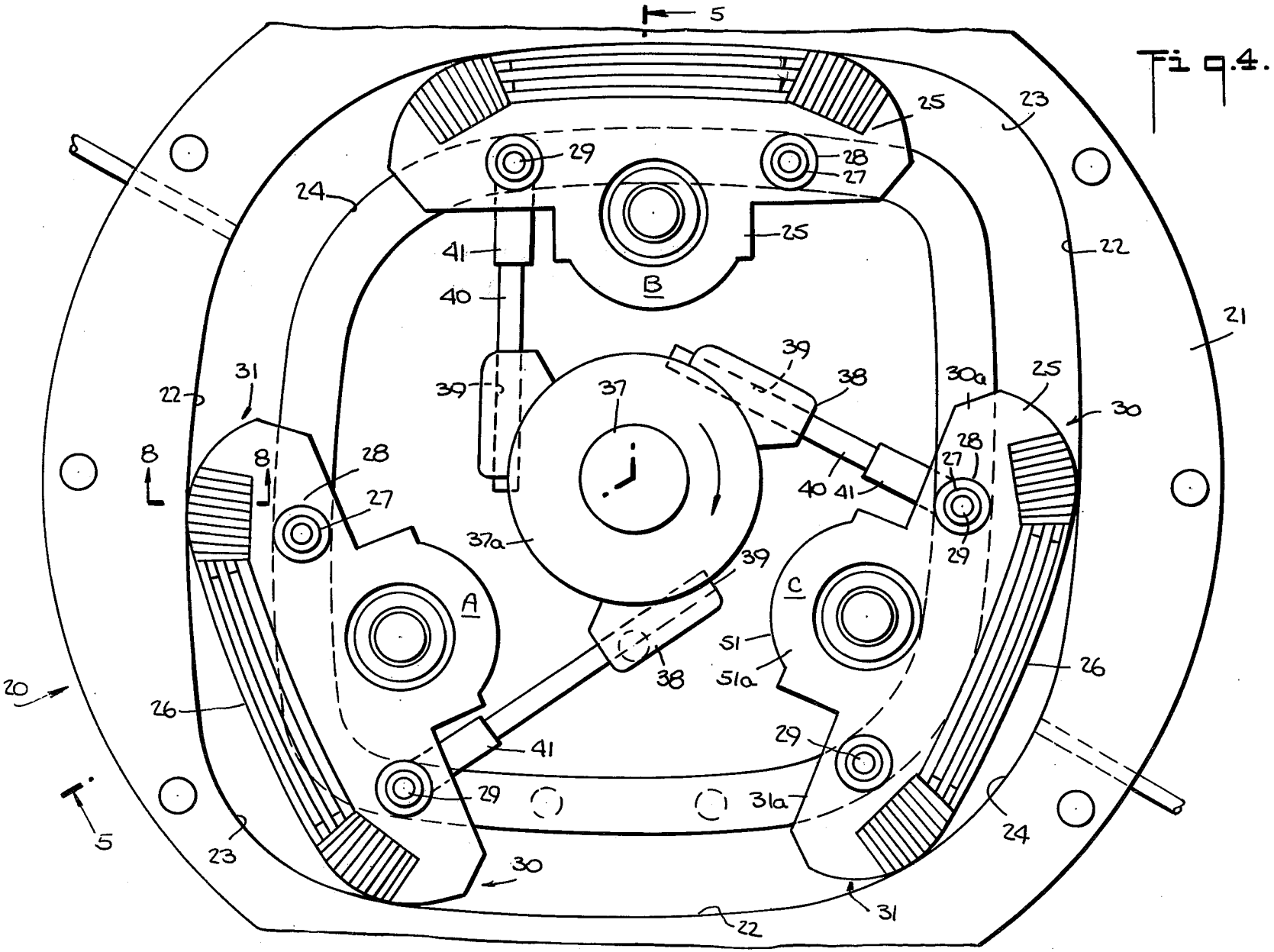
FIG. 4 is a vertical section view of the engine showing the interior of the housing, the positioning of the sliding pistons relative to the drive shaft, and the piston sealing means.

Disposed within the annular housing are a plurality of sliding pistons 25, each having a face portion 26 disposed adjacent to inner walls 22 of the housing (FIGS. 3 and 4). When the housing has a substantially rectangular form with four walls, the plurality of sliding pistons 25 can comprise three sliding pistons. The sliding pistons in FIGS. 3 and 4 are further identified by the letters A, B and C. The movement of the sliding pistons within the annular housing 21 is controlled by pairs of rollers 27 and 28 mounted by means of shafts 29 adjacent each of the opposite end portions 30 and 31 of the sliding pistons.

Figure 5:
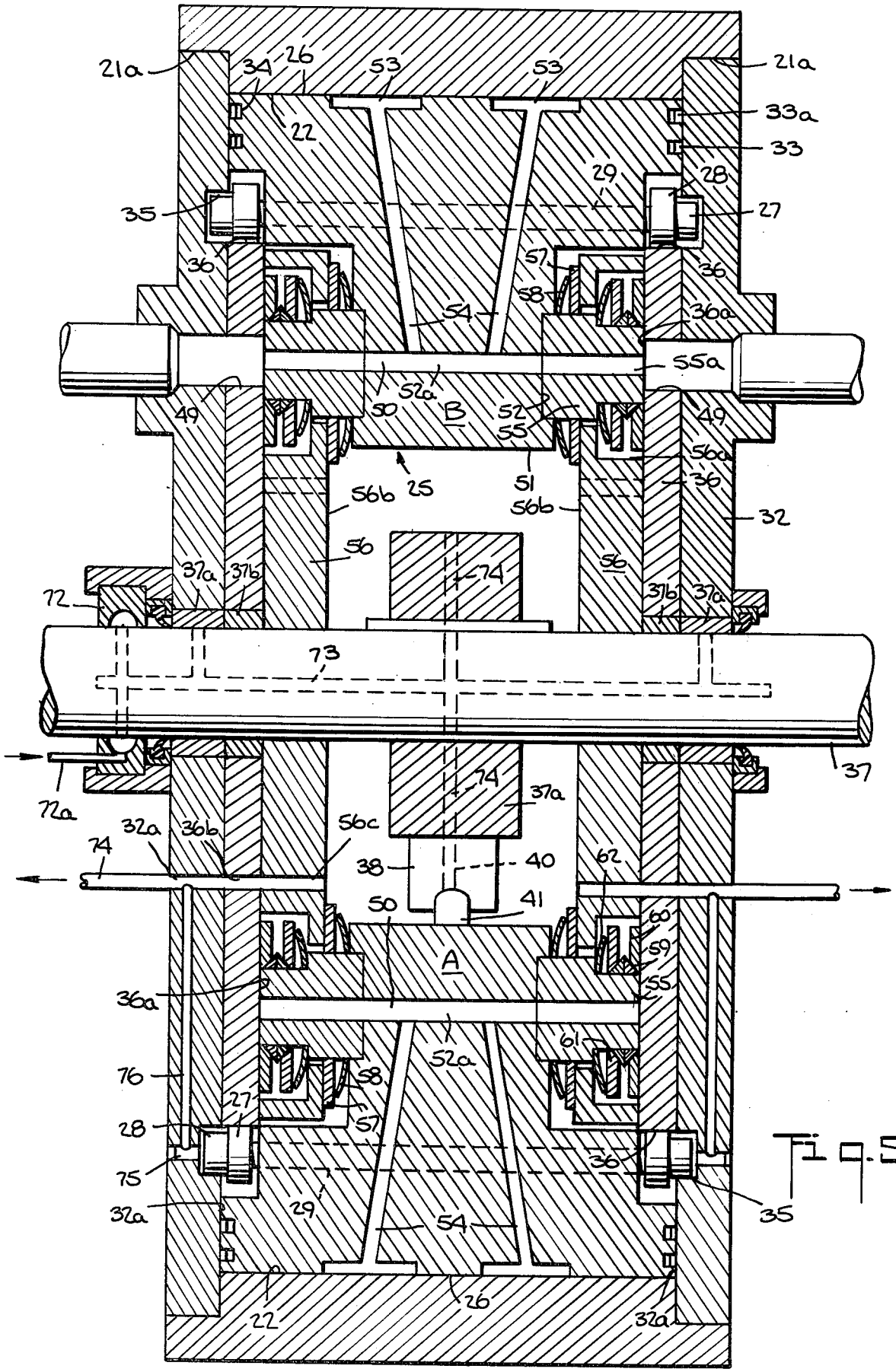
FIG. 5 is a vertical section view of the engine taken along the lines 5—5 in FIG. 4, and showing the valve porting and sealing constructions.
Figure 6:
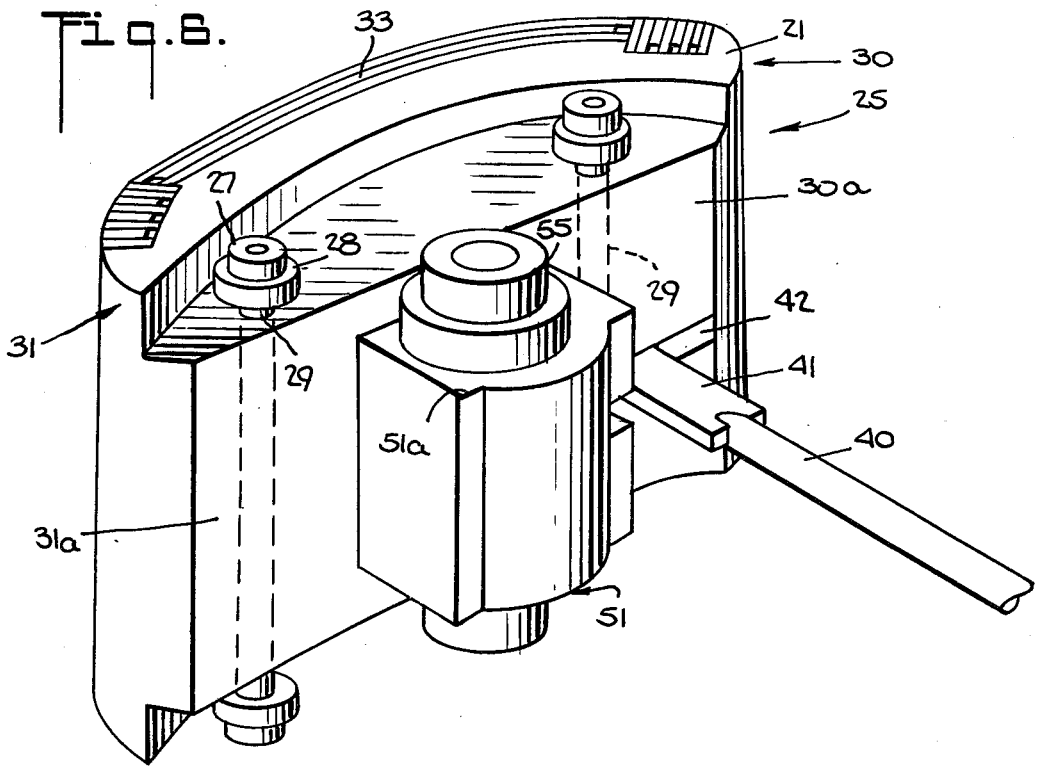
FIG. 6 is a perspective view of the inner portion of one of the sliding pistons.

As shown in FIG. 5, the engine 20 further comprises a pair of end plates 32 mounted upon the opposite flanges 21*a* of housing 21. The end plates are in sliding contact with pairs of side seals 33 of pistons 25 (FIGS. 5 and 6). The side seals are disposed in grooves 34 (FIG. 5) extending along the opposite sides of each of the sliding pistons. Wave springs 33*a* within the bottom portion of each of grooves 34 bias the seals outwardly against the inner surfaces of the end plates.

Each of the end plates 32 contains a cam track 35 in the form of an annular groove extending about the inner surface 32*a* of the end plate (FIG. 5). Rollers 27 which are in rolling engagement with cam track 35 are pivotally mounted with respect to pistons 25 by shafts 29. Since the location of rolling contact of each of rollers 27 is at the outermost portion of the rollers taken in the radial direction, cam tracks 35 serve to restrain the sliding pistons from moving outwardly toward inner walls 22. Thus, inertia forces which urge the sliding pistons outwardly as they rotate within housing 21 are opposed by the forces transmitted to rollers 27 by cam track 35.

Rollers 28 which are coaxially mounted with rollers 27 on shafts 29 are in rolling contact with stationary cams 36 each of which is mounted upon a different one of end plates 32. Since the portion of each of rollers 28 nearest to the longitudinal centerline of the engine engages the outer surface of stationary cams 36, the stationary cams restrain the sliding pistons from moving inwardly with respect to the longitudinal centerline of the engine. Since rollers 27 and 28 are individually mounted for rotation with respect to shafts 29, the rollers can assume their own rotational speeds and directions of rotation as the sliding pistons rotate about the housing. It should be noted that rollers 27 and 28 rotate in opposite directions with respect to one another due to the locations of their rolling contact with cam tracks 35 and stationary cams 36, respectively.

As shown in FIG. 4, each of sliding pistons 25 are positioned with respect to one another within housing 21 by means of drive shaft 37 having sockets 38 equally spaced about the periphery of hub 37*a* of the drive shaft. Each of the sockets contains a bore 39 extending through the socket in a direction substantially tangential to the drive shaft. A connecting rod 40 is pivotally connected to each of the sliding pistons by rod ends 41 (FIGS. 4 and 5). Thus, each rod end 41 extends into slot 42 in pistons 25 and rotatably engages shaft 29 extending through the sliding piston (FIG. 6). The connecting rods 40 may be pivotally coupled to either the leading or trailing end of their respective sliding pistons as determined by the direction of rotation of the drive shaft. As shown in FIG. 4, connecting rods 40 are pivotally connected to the trailing ends of each of pistons 25. The end of each connecting rod 40 opposite to its pivotal coupling to the respective sliding pistons is slidably engaged with bore 39 in socket 38 of the drive shaft (FIG. 4). Accordingly, the movement of each sliding piston 25 within housing 21 is controlled by cam tracks 35 and stationary cams 36 as the connecting rods and sockets position the sliding pistons circumferentially apart from one another and couple the pistons to the drive shaft 37.

As shown in FIGS. 4 and 5, rounded corners 23 and 24 of the housing in conjunction with the face portion 26 of a piston and the inner face 32*a* of each of the end walls 32 adjacent the rounded corners form the chambers of the engine. Rounded corner 23 in the upper right corner as viewed in FIG. 4 forms the wall of a chamber into which is induced a fuel-air charge. Thus, as the B piston advances to adjacent rounded corner 23, a chamber is progressively formed between the face 26 of the piston and the surface of rounded corner 23 into which an intake charge flows. The volume of the chamber is controlled by both the radius of curvature of the rounded corner and the form of face 26 of the piston. The face can be convex as shown in FIG. 4, or other forms such as flattened, concave, etc. Decreasing the radius of curvature of rounded corner 23 increases the volume of the chamber. Flattening or increasing the radius of curvature of the face 26 of the piston also increases the volume of the chamber. Correspondingly, opposite changes can result in a reduced volume for the chamber.

Compression occurs when a piston advances from a rounded corner 23 after having induced an intake charge. Thus, as the B piston advances beyond rounded corner 23, the chamber volume is reduced as the piston approaches the flat portion of inner wall 22 at the right as viewed in FIG. 4. The compression ratio is in part determined by the volume of the passages within the piston since a portion or substantially all of the intake charge is compressed into this volume when compression is completed. Thus, the compression ratio is a function of the ratio of the volume of the chamber formed adjacent rounded corner 23 and the volume of the passages extending through the piston.

Combustion takes place when the charge is compressed within the interior passages of the piston. Accordingly, combustion occurs during a substantially constant volume process, that is the constant volume within the interior of the piston.

During operation of the engine, expansion of the high pressure gas products of combustion takes place in the chambers formed by the sliding pistons and the inner walls of the housing, thereby creating a force on the sliding pistons which causes the sliding piston to rotate within housing 21 in the direction of the arrow shown in FIG. 4. The force of the expanding gas applied to the pistons is opposed by the supporting action of the rollers 27 and 28 against the cam tracks and the stationary cams, respectively.

At the time of expansion such as expansion of gases against the C piston 25 in FIG. 4, the leading rollers 27 and 28 are approaching the straight portion of the cam track and cam. Accordingly, the pressure of expansion of gas applied to face 21 of the C piston, creates a clockwise moment on the piston which causes the leading rollers to advance in a clockwise direction into the straight portion of the cam track and cam. Gas force pressures applied to the C piston also are opposed by the support of the trailing rollers 27 and 28 with respect to the cam track and cam; however since the trailing rollers are not approaching a straight portion of the cam track and cam, these rollers are restrained by the cam track and cam and become substantially the pivot point about which the moment applied to the piston acts.

The movement of the sliding pistons is transmitted by their respective connecting rods 40 to the drive shaft 37 and in this way the sliding pistons apply torque to the drive shaft in the direction of the arrow in FIG. 4. Since the sliding pistons travel with a rocking-like motion as they pass either of corners 23 or 24 of the housing, the slidable fit of connecting rod 40 with respect to bore 39 enables the rocking motion to be accommodated.

As a piston such as the C piston advances toward rounded corner 24, a chamber of increasing volume is progressively formed adjacent face 26 of the piston. The high pressure products of combustion within the piston expand into the chamber so formed and thereby provide the power portion of the engine cycle.

The provision of three pistons 25 in a housing having four inner walls enables each piston to undergo two complete cycles of operation during a single rotation of the drive shaft 37. Thus, each piston undergoes two power strokes per revolution of the drive shaft. With this arrangement, each chamber formed by either rounded corner 23 or 24, always has the same portion of a cycle therein. Accordingly, the intake stroke is always accomplished adjacent a rounded corner 23 while a power stroke is always accomplished adjacent a rounded corner 24. Reducing the number of pistons from three, as shown in FIG. 4, reduces the number of power cycles per revolution of drive shaft 37. If the number of pistons is increased from the three shown in FIG. 4, the number of power strokes increases per revolution of the drive shaft.

Figure 1:
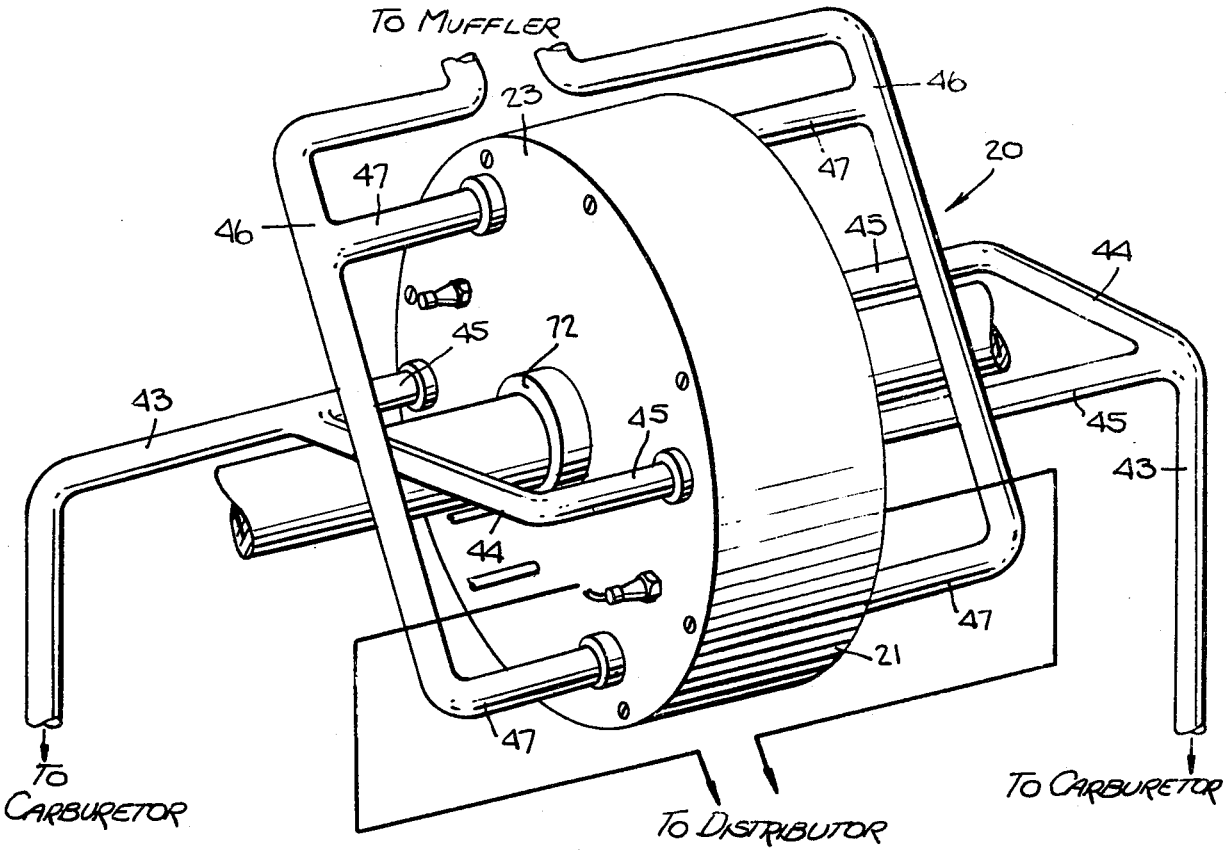
FIG. 1 is a perspective view of the exterior of the rotary engine of the invention showing the housing, the exhaust manifolds, and the intake manifolds.

In FIG. 1 there is shown induction system 43 which is connected to manifold 44 having intake branches 45. A suitable fuel metering device such as a carburetor (not shown) furnishes a fuel-air charge to the engine. Further as shown in FIG. 1, the engine is provided with exhaust manifolds 46 having branches 47. The manifolds 46 can be connected to a suitable muffler or exhaust system.

Figure 2:
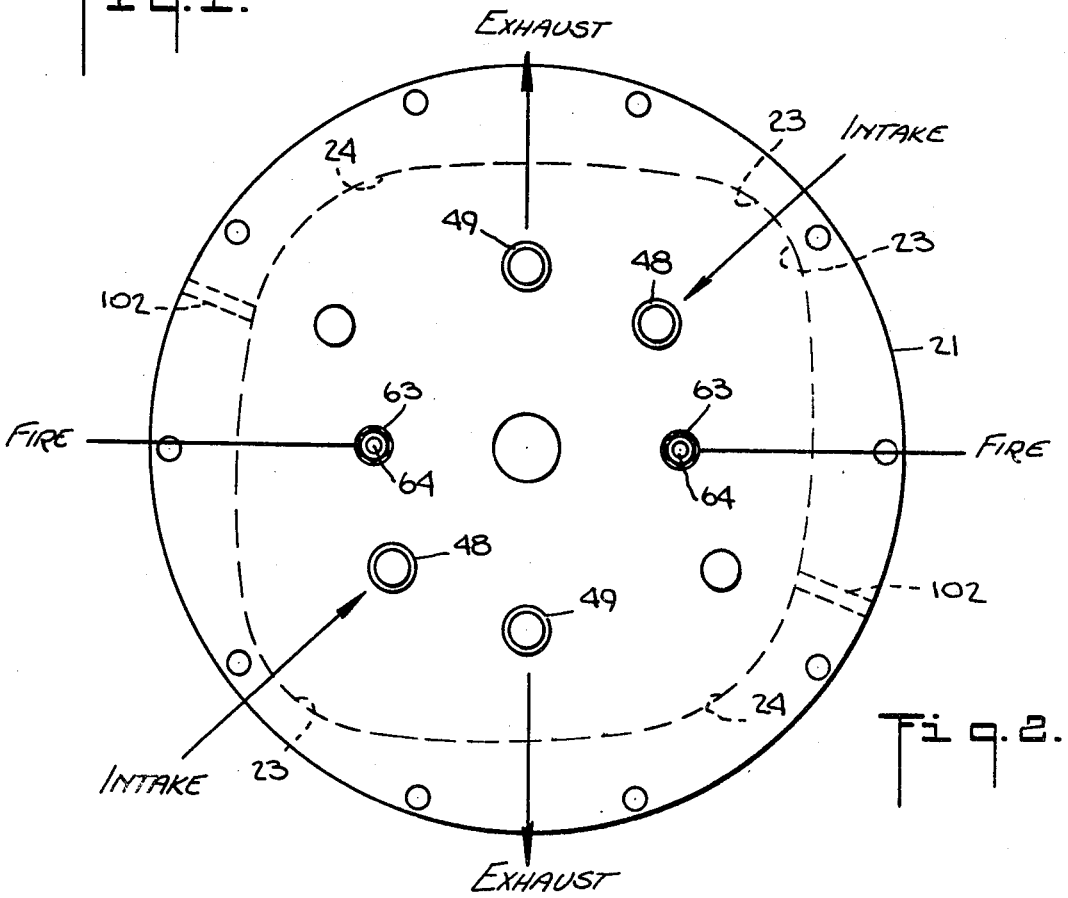
FIG. 2 is a side elevational view of the engine showing the positions of the intake and exhaust ports as well as the spark plug locations.

As shown in FIGS. 2, 3 and 5, end plates 32 and stationary cams 36 contain a plurality of intake ports 48 and exhaust ports 49. The intake ports and the exhaust ports can have various forms such as a circular form or an elongated form of the type shown in FIG. 3. The sequential alignment of passages 50 in sliding pistons 25 enables gas to flow with respect to a sliding piston by means of either an intake port or an exhaust port.

Figure 7:
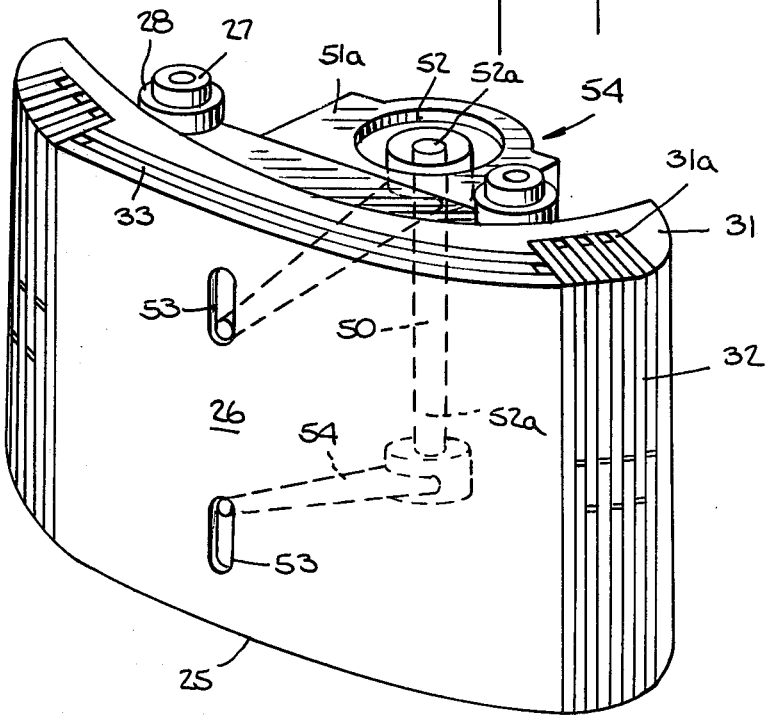
FIG. 7 is a perspective view of the outer face portion of one of the sliding pistons.

As shown in FIGS. 5, 6 and 7, each of the sliding pistons is provided with projection 51 extending outwardly with respect to inner surfaces **30*a* and 31*a* of the sliding piston. At each of the opposite sides 51*a* of the projection 51 there is provided recess 52 having central opening 52*a*. Ports 53 (FIGS. 5 and 7) at the face portion 26 of each sliding piston are spaced apart with respect to one another and are each connected by a passage 54 to central openings 52*a*** of the sliding piston.

To enable each of the central openings **52*a* to be sequentially placed in communication with either an exhaust port or intake port, recess 52 of each sliding piston is provided with nipple 55 which is adapted to extend adjacent to, but at a slight clearance from, the inner face 36*a* of stationary cam 36. Each of nipples 55 extends through seal plate 56 having a stepped opening 56*a* which is adapted to receive tube 55. The seal plates cover ports 48 and 49 whenever the ports are not in alignment with nipples 55. To seal each tube with respect to seal plate 56, there is provided seal washer 57 which is biased against inner surface 56*b* of seal plate 56 by spring washer 58. The spring washer can be a Belleville-type washer or a wave washer. To seal each nipple 55 with respect to inner surface 36*a* of stationary cam 36, there is provided split tapered washers 59 which are mounted about the periphery of nipple 55 in a back-to-back relation. Seal washer 60 has a tapered opening which mounts upon the outer one of the tapered washers 59. Washer 61 has a tapered opening which is seated upon the inner split tapered washer 59. Spring washer 62, which again can be a Belleville-type washer or a wave washer, biases seal washer 60 against the inner surface 36*a* of stationary cam 36 to form a fluid-tight seal. Thus, it can be seen that a fluid-tight connection is maintained between passage 50 of each sliding piston and either an exhaust port or an intake port. Furthermore, seal washers 57 in conjunction with seal plate 56 prevent leakage from passage 50** within each sliding piston.

The elongation of the opening of the intake ports 48 and the exhaust ports 49 as shown in FIG. 3 can be utilized where it is intended to provide an abrupt opening of a given port to a sliding piston as the passage 50 in a given sliding piston advances into alignment with a port. If the ports have circular openings and nipples 55 have circular openings, it can be seen that a progressive alignment of two circular openings will result in a gradually increasing opening to a maximum open value, followed by a progressively decreasing opening to a zero or closed value.

The cross-sectional area of the opening **55*a* of each nipple 55 as well as the cross-sectional area of passage 50 and passages 54 of each sliding piston 25 are selected to be a compromise between maintaining free-flow of an intake charge or exhaust gas and having a sufficiently small volume within the passages. The reason for this is that the compression ratio of the engine is dependent in part upon the volume within the passages extending from piston ports 53 through the openings 55***a* of tubes 55. Thus, a fuel-air charge taken in during the intake portion of the cycle is compressed into the volume within the sliding piston and, accordingly, the level of compression is determined by such internal volume. In achieving the compromise it is desired that there be a free flow into and out of the passages of the sliding piston since this determines the volumetric efficiency of the engine. Of course the volumetric efficiency of the engine can be augmented by the provision of a blower or supercharger for delivering the fuel-air charge to the engine. In place of a fuel-air charge, air alone can be delivered by the passages. Fuel for combustion would then be delivered by fuel injection into the passages or directly into the interior of the housing adjacent corners in which intake chambers are formed or into the location therein where compression takes place.

Further as shown in FIG. 3, spark plug openings 63 extend through end plates 32 and stationary cam 36 in order to place the spark plug openings in communication with openings 55*a* in nipples 55. Spark plugs 64 are mounted in the spark plug openings. Any conventional ignition system can furnish the spark potential and ignition timing. Thus, for example, a conventional magneto or distributor can time the ignition pulses to be delivered by spark plugs 64.

Upon ignition, combustion progressively advances through opening 55*a* of nipple 55 and through passages 50 and 54 of piston 25. During commencement of the combustion process, face portion 26 of the piston adjacent ports 53 is substantially contiguous with an inner wall 22 of the annular housing. As a result, combustion can take place in the substantially constant volume within the passage of the piston. Thereafter upon advancement of the piston toward a junction or corner portion 24 of the housing (FIG. 4), the face portion 26 of the rounded piston commences to create a cavity or expansion chamber between the face portion and the surface of inner wall 22. From this point on the pressured products of combustion within the piston can commence to expand, thereby creating pressure forces on face portion 26 which drive the piston in rotation. Of course, once the opening 55*a* of nipple 55 has advanced beyond a spark plug opening 63, opening 55*a* is sealed by the inner surface of stationary cam 36*a* and thereby the constant volume combustion within the piston is achieved.

Opening 55*a* of nipple 55 remains closed during the expansion portion of the cycle of the engine. Once expansion has taken place, the continuing rotary movement of the piston adjacent corner 24 of the housing results in the maximum volume of the expansion chamber commencing to be reduced. Thus, face portion 26 of the sliding piston gradually reduces the volume following expansion as the face portion approaches inner wall 22 extending beyond corner 24. At this point opening 55*a* of the sliding piston commences to align with exhaust port 49, thereby enabling exhaust gas to pass outwardly from the sliding piston.

As shown in FIGS. 4, 6 and 7, end portions 30 and 31 of each sliding piston are substantially rounded or cylindrical in form while face portion 26 is substantially flattened or slightly convex in form. The form of face portion 26 affects the volume of the expansion cavity or chamber which can be formed with corner 24 of the inner walls 22 of the housing and the volume of the intake cavity or chamber formed by the face portion 26 of the sliding piston with corner 23 of the housing. Thus, increasing the convex extent of face portion 26 reduces the potential cavity or chamber which can be created. A flattened face portion can provide an intermediate size cavity or chamber. Compression is obtained following the forming of an intake chamber when the face of the piston mates with the surface of inner wall 22. Thus, the mating action forces the charge into the interior of the piston.

In order to seal end portions 30 and 31 of a sliding piston with respect to inner walls 22 of the housing to withstand combustion pressures, there are provided a plurality of strip-like seal assemblies 65. The seal assemblies can comprise a plurality of strips 66 and 67 of a suitable seal material whether metallic, carbon, or the like. The seal assemblies can also prevent the presence or entrance of oil into the chambers found adjacent to the rounded corners of the housing. Thus, the seals accomplish the functions of compression seals and oil seals. As shown in FIGS. 9 and 10, strips 66 are adapted to extend outwardly with respect to strips 67. As shown in FIG. 10, strips 66 and 67 can be of disequal lengths in order to stagger the function of one strip to another. In order to bias either strips 66 or 67 toward the inner surface 32*a* of each of end plates 32, crescent-shaped springs 68 are disposed in recesses at adjacent ends of either strips 66 or 67. Pins 69 are adapted to extend through openings in the strips in order to retain the strips with respect to recesses 30*a* and 31*a*, of ends 30 and 31, respectively, of the sliding piston. In order to urge the exposed edge of strip 66 against the surface of inner walls 22, wave spring 71 are disposed between strips 66 and the recess in the sliding pistons as shown in FIG. 8.

As shown in FIGS. 1 and 5, end plate 32 may be provided with oil supply ring 72 located outwardly in a radial direction from the drive shaft 37 to enable oil to be introduced to the drive shaft bearings 37*a* and 37*b* from lubricating oil supply pipe 72*a*. Shaft 37 is provided with central oil passage 73 which serves to introduce lubricating oil to the drive shaft bearings as well as to sockets 38 of the drive shaft through which the connecting rods 40 extend and move in a sliding relationship. Passages 73 is connected to radial passages 74 which are adapted to spray oil onto the connecting rods and the sliding pistons 27 and 28 as well as the inner walls of the housing 21 and end plates 32 for the purposes of lubrication and cooling.

The engine is provided with an oil pump (not shown) which delivers oil through a suitable filter (not shown) to supply pipe 72*a*. The oil sprayed upon the rollers 27 and 28 and inner walls of the chamber is collected, pumped through an oil filter, and returned to the supply pipe 72*a*. Oil is transferred to the pump by passages 74 which communicate with the interior of the engine through openings 32*a* in end plates 32, openings 36*b* in stationary cam 36, and one of a plurality of openings 56*c* in plates 56. Passages 75 and 76 return oil from adjacent cam tracks 35 in end plates 32 to passages 74. Since an appreciable amount of heat extracted from the engine is released to the lubricating oil, a suitable oil cooler (not shown) can be used.

In FIG. 12 there is shown another embodiment of the invention which can be a rotary piston fluid flow device such comprises annular housing 111 having a plurality of inner walls 112*a–f* connected to one another by rounded corners 113*a–f*. Each of inner walls 112*a–f* are substantially convex in form and are blended into the adjacent rounded corners. Accordingly, the profile of the interior of the housing 111 comprises inner walls 112*a–f* which are convex and rounded corners 113*a–f* which are concave.

Engine 110 further comprises a plurality of rotating pistons 114 which are adapted to rotate adjacent inner walls 112 and rounded corners 113. Each of pistons 114 is coupled to drive shaft 117 by a connecting rod 115 which is pivotally connected to the piston by a rod end 115*a*. The other end of each of the connecting rods is slidingly connected to sockets 116*a* in hub 116 attached to drive shaft 117. Thus, the arrangement of connecting rods and sockets serve to position each of the pistons spaced apart from one another within the housing.

Each of the pistons 114 has an outer face portion 118 which is disposed adjacent to the inner walls of the housing. The outer face portion is concave in form and can be adapted to substantially mate with the convex surface of the inner walls 112. Thus, as shown in FIG. 12, pistons 114 identified as B and D have outer face portion 118 substantially contiguous with the convex surface of inner walls 112. In the portion of the operating cycle where a piston is in the position shown for either of pistons B or D, there is substantially no space or chamber between the outer face of the piston and the adjacent inner wall of the housing. As a result, in the case of the compression portion of the cycle, maximum compression is obtained, while in the exhaust portion of the cycle the completion of the discharging of exhaust gas has been achieved.

By way of example, an intake chamber can be formed at corner 113*f* by a piston such as piston A as shown in FIG. 12. When piston A advances to adjacent inner wall 112*a*, piston A compresses the charge into the passage 125 within the piston (FIG. 13). At this point, ignition occurs. Thereafter an expansion chamber is formed at corner 113*a* (FIG. 12). The exhaust stroke takes place when a piston A is contiguous with inner wall 112*b*. Thereafter a new cycle commences for the same piston with intake at corner 113*b*, compression and combustion at inner wall 112*c*, expansion at corner 113*c*, and exhaust at inner wall 112*d*. The last cycle of the same piston comprises intake at corner 113*d*, combustion and compression at inner wall 112*c*, expansion at corner 113*e*, and exhaust at inner wall 112*f*.

In order to cause the pistons 114 to rotate with respect to the housing and to alternately form chambers with respect to rounded corners 113 and to alternately establish minimum clearance with the convex surface of the inner walls, the movement of the rotating pistons is controlled by a construction of rollers and cams as shown in FIG. 12. Thus, each piston is provided with a first pair of rollers 119 at one end thereof with each of rollers 119 being at an opposite side of the piston and a second pair of rollers 120 at the other end of the piston again with each of rollers 120 being at a different opposite side of the piston. Rollers 119 and 120 of each side of the piston roll upon the outer surface of a different one of a pair of cams 121. Thus, a cam 121 is positioned at each of the opposite sides of the housing 111 in order to engage the rollers at each of the opposite sides of pistons 114. The profile of cams 121 can generally correspond to that of inner walls 112 and rounded corners 113. Accordingly, pistons 114 are controlled by rollers 119 and 120 to alternately assume the positions shown in FIG. 13.

Since rollers 119 and 120 bear upon the radially outwardly facing surface of cam 121, these rollers can support the pistons and guide the pistons with respect to the centerline of the engine. In order to control pistons 114 from moving outwardly with respect to the inner walls 112 of the housing, each of the pistons is provided with a pair of rollers 122 which engage cam 123*a* of cam track 123. Thus, the engagement of rollers 122 with cams 123 provides third points of support at each side of the piston, the first two points of support for each piston being provided by rollers 119 and 120.

Pistons 114 are provided with internal passages similar to those heretofore discussed with respect to other embodiments of the invention. The internal passage of each of pistons 114 deliver a charge to a chamber formed between a piston and a rounded corner, contain a fuel-air charge during the combustion portion of a cycle, and enable exhaust gas to be discharged from the engine following expansion of the products of combustion adjacent a rounded corner 113. Thus, as shown in FIG. 13, passage 125 within piston 114 is connected to recess 126 at each of the opposite sides of the piston. Passage 125 is connected to a radially extending passage (not shown) which terminates in openings in outer face portion 118 of the pistons. Nipple 127 is mounted in recess 126 and extends beyond the side portion of the piston. Each of nipples 127 extend through stepped openings 128 in seal plates 129 disposed at each of the opposite sides of the engine. The free end portions 127*a* of nipples 127 are closely spaced with respect to end plate 130, there being a different end plate 130 at each of the opposite sides of the engine. End plate 130 contains a plurality of ports 131 through which a fuel-air charge can be delivered or through which exhaust products may be discharged.

In order to seal nipples 127 about their outer periphery, split seal rings 132 are mounted about each of nipples 127. The outer split seal rings 132 bear against spacers 133 which in turn engage flange 134*a* of recessed ring 134. In turn, ring 134 is mounted within the stepped opening 128 of seal plate 129. The seal construction further includes washer 135 mounted within the opening of recessed ring 134 and engaging the inner split seal 132. Spring 136 which can be in the form of a wave washer urges recessed ring 134 and thereby the seal assembly outwardly toward seal plate 129 and end plate 130. Spring 135*a* urges washer 135 against outer seal ring 132. With this arrangement, flow can take place through a stationary port 131 and passage 125 of a piston 114 without leakage.

The provisions for ignition, the flow of intake charges, the flow of exhaust gas, lubrication, and the like, of engine 110 can be similar to that described above for other embodiments of the invention.

In order to increase the mass flow and the work produced during the expansion portion of the cycle, pressured steam can be injected through the housing as compression takes place. Such steam injection can be directed toward the trailing portion of a piston. Thereafter expansion of not only the products of combustion but also the steam takes place thereby increasing the work output of the engine. As shown in FIG. 12, steam injectors 146 having control valves 147 can be positioned adjacent inner walls 112*a*, 112*c* and 112*e* to inject steam during compression. The control valves are programmed by actuator 148 which is synchronized with drive shaft 117.

In FIG. 14 there is shown another embodiment of the rotary piston fluid flow device of the invention such as internal combustion engine 137. Housing 138 of the engine has inner walls 139 substantially in the form of an ellipse. The engine includes a pair of pistons 140 coupled by connecting rods 141 to hub 142 of drive shaft 143. Each of the pistons can be controlled to rotate within the housing by means of pairs of rollers 144 and 145 similarly, as discussed above, with respect to other embodiments of the invention.

In the position shown in FIG. 14 an intake chamber can be formed at one end portion 139*a* of the inner walls while an expansion chamber can be formed at the other end portion 139*b* of the housing. With this arrangement compression occurs when a piston moves to adjacent portion 139*c* of the inner walls. When a piston moves to adjacent portion 139*d* of the inner walls, an exhaust stroke occurs.

With the arrangement shown in FIG. 14 each of the pistons undergoes a complete cycle during one rotation of drive shaft 143. The outer face portion 140*a* of each of the pistons can be formed to be convex as shown in FIG. 14, substantially flattened, or even somewhat concave in order to determine the displacement of the engine and its compression ratio.

Another embodiment of the invention is shown in FIG. 15. Engine 150 includes an annular housing 151 (shown cut away) substantially of the form of housing 111 of engine 110. Thus, the housing includes six corner portions with six wall portions disposed therebetween. Housing 151 can have convex wall portions as in housing 111.

Pistons 152 of engine 150 can be similar in form to pistons 114 of engine 110. Thus, pistons 152 can be provided with rounded end portions 152*a* and 152*b* with a concave face portion 152*c* (FIG. 16). Pistons 152 are provided with pairs of rollers 153 mounted on shafts 153*a* at each of the opposite ends of the pistons for controlling the pistons in a manner similarly as is done by rollers 120 of pistons 114 in engine 110 (FIG. 15). Thus, rollers 153 are adapted to engage an outside cam similar to cam 121 of engine 110. Rollers 153 in conjunction with the outside cams enable the fluid pressure resulting from combustion to drive pistons 152 in rotation within housing 151. At the same time rollers 153 support the pistons 152 against radial movement toward the centerline of engine 150. The piston connecting rod 153*b* is attached to rod end 153*c* which is pivotally mounted on shaft 153*a*.

Again, similarly as an engine 110, pistons 152 further include rollers 154 which are adapted to engage a cam track similarly as rollers 122 of pistons 114 of engine 110. Rollers 154 restrain the pistons against radial movement in a direction extending outwardly from the centerline of the engine. It should be noted that there are a pair of rollers 154, the pair being located in the central portion of the piston with each different roller of the pair being adjacent a different opposite side of the piston.

End plate 155 of the engine is provided with a plurality of ports 156 for accomplishing the functions of either the introduction of an inward flow of a charge to the engine or the outward flow of exhaust gas from the engine. A single port of the plurality is shown in FIG. 15. At each of the opposite sides of piston 152 there is provided an internal passage 157 which is connected by transverse passages (not shown) to piston ports 158 at concave face 152*a*. Mounted within each of internal passages 157 at each of the opposite sides of the piston is a nipple 159 which has an outer end portion 159*a* in contact with inner surface 155*a* of end plate 155. As in the other embodiments of the invention, the alignment of a nipple of a piston with a port enables flow to pass with respect to the port and the internal passage 157 of the piston. When the nipple passes beyond a given port, flow is terminated. To cover ports 156 after a nipple has passed with respect thereto there is provided a moving seal plate 160 having elongated openings 160*a* surrounding end portion 159*a* of the nipple as in the other embodiments of the invention (FIGS. 15 and 16). There is a seal plate disposed adjacent each of the end plates at the opposite sides of the engine. In elongated opening 160*a* there is disposed rectangular block 161 which has a circular opening 161*a* fitted about the outside diameter of end portion 159*a* of the nipple. The block 161 can reciprocate radially in the elongated opening 160*a* of seal ring 160 as the pistons rotate within the engine. Thus, the movement of the pistons in response to control by the cams and cam tracks imparts a reciprocating radial movement to the pistons and thereby nipples 159.

To seal block 161 with respect to nipple 159 there is provided split chamfered seal rings 162. Shouldered ring 163 is mounted upon nipple 159 and bears against the inner one of rings 162. Washer 164 mounted upon shouldered ring 163 is in contact with the inner surface 160*b* of the seal ring and thereby closes the clearance between block 161 and elongated opening 160*a*. In order to maintain ring 163 against rings 162 there is provided a plurality of compression springs 165 mounted in bores 152*a* of piston 152. These springs bear upon the shoulder of rings 163 and urge the ring outwardly. Compression springs 166 mounted in bores 152*b* of the piston bear upon tabs 164*a* of washer 164 in order to urge the washer against block 161 and the inner surface of seal plate 160.

In order to augment the mass of the vapor and gas to be expanded during the expansion portion of the cycle of the engine, liquid material, such as water, can be injected into the expansion chamber. Thus, as shown in FIG. 15, injector valves 170 can deliver water under high pressure from lines 171 and supply pipe 171*a* to ports 172 are exposed to the interior of the housing adjacent corners 24 thereof. Thus, the injector valves can inject water under pressure greater than that within the expansion chamber following ignition. The injector valves 170 for each of the expansion chambers is synchronized with the drive shaft of the engine by control 174 and actuating shaft 174*a* which drives operating rods 170*a* of each injector valve in order to time the injection of water to occur as a given sliding piston undergoes the expansion portion of the cycle. Thus, control 174 can be coupled by mechanical drive 175 schematically shown in FIG. 15 to the drive shaft of the engine. The mechanical drive can typically be a cam shaft driven from the drive shaft by gearing, a drive chain, a drive belt, etc.

The timing of water injection by means of injector valves 170 can be set to occur immediately following the ignition of a fuel-air charge within the interior passages of a sliding piston by means of a spark plug 64. Thus, the location of ports 172 as shown in FIG. 2 can be between rounded corner 23 and rounded corner 24, thereby being at a location in alignment with nipples 159 of a sliding piston at the time of ignition. After injection of water takes place, the high temperature gas of the ignited fuel-air charge and the elevated temperature of face 26 of the sliding piston and inner wall 22 of housing 21 vaporize the water substantially instantaneously. Accordingly, the vaporized water, now in the form of steam, expands with the ignited fuel-air charge and delivers the driving force to the sliding piston. The injection of water serves to cool the face of the piston and the inner wall 22 of the housing. In addition, the injection of water increases the mass of vapor and gas being expanded within the expansion chamber formed between sliding piston 25 and rounded corner 24. A further advantage of the injection is that it drives the charge toward face 152*a* of the piston and its interior, thereby assuring that complete combustion occurs.

Since the latent heat of vaporization of the injected water is great, notwithstanding the injection of a small mass of water, the water is capable of extracting excessive heat from the piston and the inner wall of the housing at rounded corner 24. The engine also receives additional cooling by means of heat released to the lubricating oil passing through the engine and by cooling means (not shown) for the housing and end plates of the engine. Thus, for example, cooling means for housing and end plates of the engine can be either water jackets connected to a liquid cooling system or a finned structure (not shown) cooled by the ambient atmosphere or forced air flow.

The engine of the invention can operate with a compression-ignition cycle, that is operate as a diesel engine. When operating as a diesel engine the engine is provided with fuel injectors 180 which are schematically shown in FIGS. 11*a*–11*f*. Thus as shown in FIG. 11*c*, when piston 25 is substantially in the position shown in the drawing where maximum compression occurs, fuel is injected by injectors 180 into the internal passages of piston 25. The heat of compression then initiates combustion therein. Combustion can occur during a substantially constant volume condition. Thereafter, expansion occurs as piston 25 advances into the position shown in FIG. 11*d*.

OPERATION

The events of the cycles of operation carried out during a complete revolution of an individual sliding piston 25 are schematically shown in FIG. 11. For the sake of simplicity only one sliding piston is shown in FIG. 11.

Figure 11A:
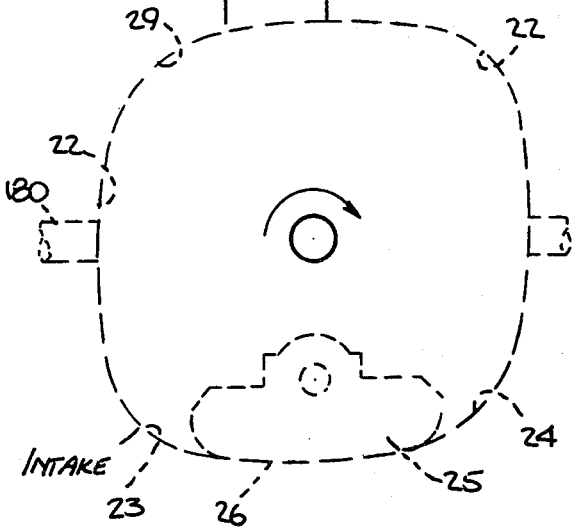
FIGS. 11*a–f* are schematic views showing the positions of a sliding piston at various different portions during the cycle of operation of the engine.
Figure 11B:
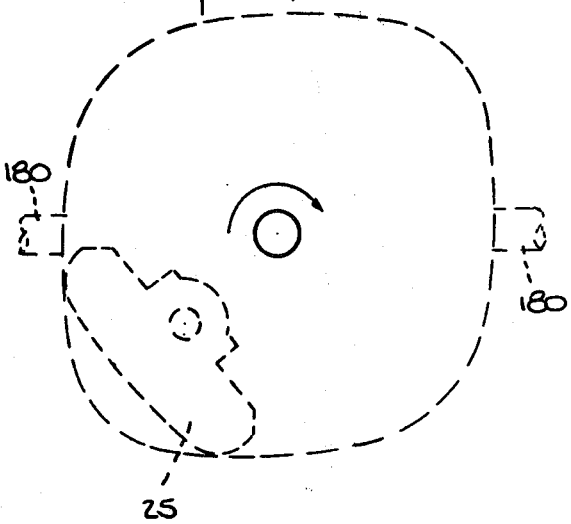
Figure 11C:
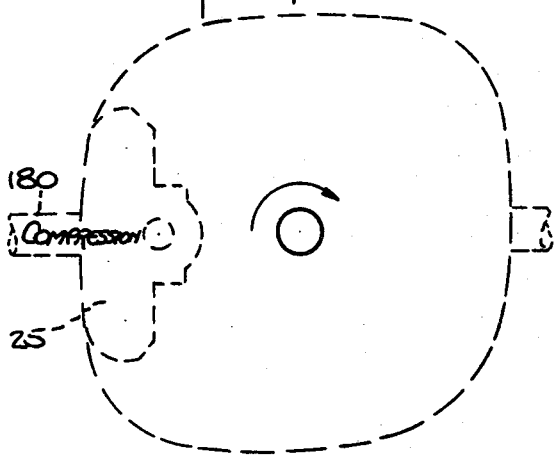

As shown in FIG. 11*a*, the sliding piston is at the end portion of an exhaust stroke from a previous cycle. As the piston moves clockwise to the position shown in FIG. 11*b*, an intake chamber of increasing volume is formed between the face 26 of the piston, rounded corner 23, and the portion adjacent thereto of the inner wall 22 of the housing. At this point a fuel-air charge is induced to flow into the chamber through induction system 43, manifold 44 and nipples 55 of the piston.

Advancement of the piston in a clockwise direction to a vertical position as shown in FIG. 11*c* effects compression of the charge within the piston. This results in a reversal of flow of the charge as the charge is returned from the intake chamber and compressed within the passages of the piston. The reversal of flow and the resulting turbulence enhance fuel-air mixing. At this point, cooling fluid can be injected as an optional provision.

Immediately after the position of the piston shown in FIG. 11*c*, the opening 55*a* of nipple 55 moves into alignment with spark plug opening 63. Upon the occurrence of ignition at spark plug 64, the compressed fuel-air charge within the constant volume of the internal passages of the piston causes a rapid increase in the pressure within the volume of the interior passages of the piston. This volume remains substantially constant as long as face portion 26 of the piston and ports 53 therein are substantially contiguous with the inner wall 22 of the housing. As an option water injection can be made following ignition of the fuel-air charge.

Figure 11D:
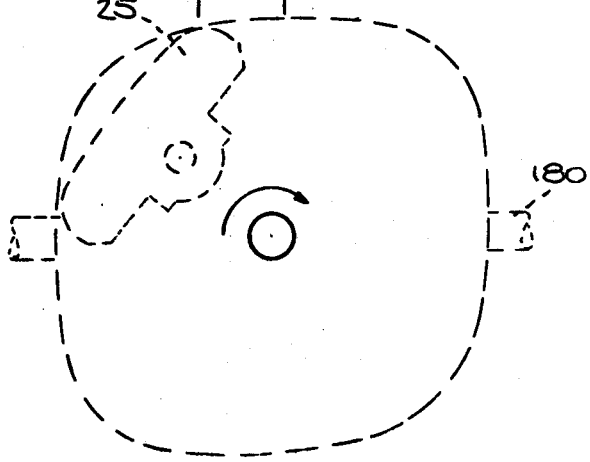

As the pistons approach the upper-left corner of the housing as viewed in FIG. 11*d*, an expansion cavity commences to be formed between the face portion 26 and the rounded corner 24 of the housing. Again the flow is reversed as the products of combustion pass from the interior of the piston into the expansion chamber. Seal assemblies 65 prevent the leakage of gas from the expansion chamber. The expanding gas applies force to the face portion 26 of the piston. Due to the position of rollers 27 and 28 at each of the end portions of the piston relative to the cam track and cam, respectively, the piston is thereby subjected to a force which drives it in a clockwise rotational direction. The movement of the piston is transmitted by the connecting rod 40 to sockets 28 and thereby to drive shaft 37. Accordingly, torque is applied to the drive shaft in a clockwise direction, thereby rotating the drive shaft.

Figure 11E:
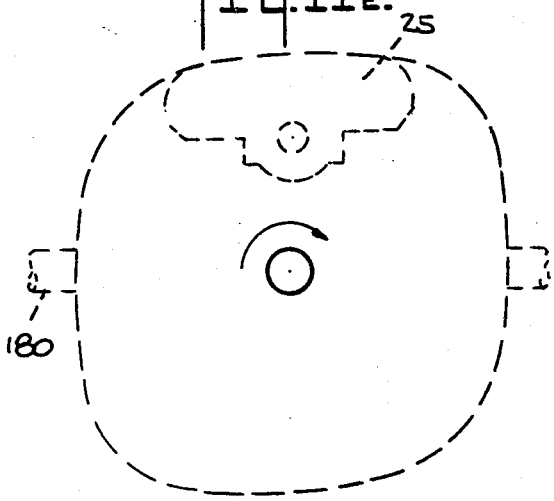

Following the expansion of the gas into the cavity formed between inner wall 22 and the face portion 26 of the piston, the piston approaches the position shown in FIG. 11*e*. In this position, opening 55*a* of nipple 55 is in communication with exhaust port 49 and, accordingly, exhaust gas is forced from the piston. At this position, the exhaust portion of the cycle has been completed since face portion 26 of the piston is substantially contiguous with the surface of inner wall 22.

Figure 11F:
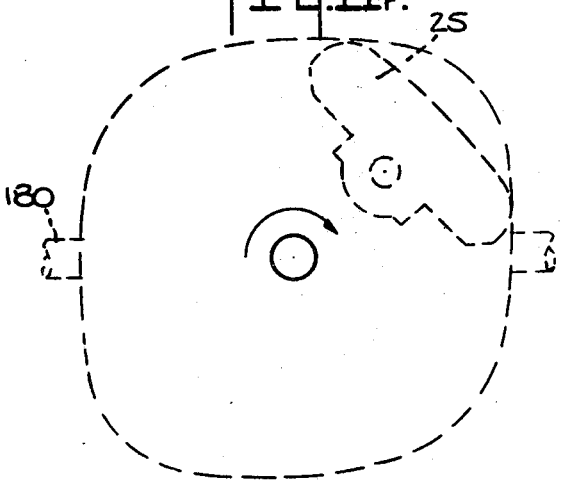

As the piston advances toward the rounded corner 23, another intake stroke commences (FIG. 11*f*). Thereafter, the cycle is repeated.

It can be noted from FIG. 4 that piston C is undergoing an expansion portion or power portion of the cycle, piston A is undergoing an intake portion of the cycle, and piston B is completing its exhaust portion of the cycle. It further can be seen that each piston undergoes two cycles during one rotation within housing 21. It can also be noted that a total of six power portions of the cycle of pistons A, B and C are distributed throughout one rotation and, accordingly, the torque delivered to the crankshaft is made more uniform.

In engine 110 of FIG. 12, each piston undergoes three cycles of operation and thereby three power strokes during each revolution of the drive shaft. In engine 110, each piston experiences a different one of the four portions of a cycle at any given time. Thus, as shown in FIG. 12, as piston A undergoes an intake portion, piston B is exhausting, piston C is undergoing expansion or power, and piston D undergoes compression.

Although the present invention has been described in its preferred embodiment of a rotary internal combustion engine, the present invention may be used as a pressured fluid motor, a fluid compressor, or a fluid pump. Thus, the apparatus of the present invention may function as a motor by introducing pressured fluid into the motor and permitting it to expand, thereby driving the rotary pistons. The pressured fluid can be either hydraulic fluid, compressed air, steam or the like to drive the sliding pistons within the main housing. When the present invention is used as a pump or compressor, a prime mover is applied to the drive shaft of the apparatus and the fluid or air to be pumped is introduced, compressed by the sliding pistons, and released in a pressured condition.

In the embodiment of the invention comprising a motor, a compressor or a pump, a cycle occurs adjacent to every rounded corner of the housing rather than adjacent successive alternate pairs of rounded corners as in the embodiment of the invention which is an internal combustion engine.

What I claim is:

1. A rotary internal combustion engine comprising:

(a) an annular housing having a plurality of inner walls extending about the interior of the housing and facing the central axis of the housing with the length of adjacent walls intersecting at a predetermined angle to one another to form a corner portion therebetween;

(b) a plurality of rotating sliding pistons each having a face portion with its length extending in the direction of the length of adjacent walls of the annular housing, the length of the face portion of the piston enabling the piston to be substantially contiguous at the end portions of the face portion to adjacent inner walls of the annular housing while the face portion forms a chamber with respect to the corner portion of adjacent inner walls, the chamber being adapted to function as one of an intake chamber for receiving an intake charge and an expansion chamber in which products of combustion are expanded, the face portion of the piston being substantially contiguous with an inner wall of the annular housing when the end portions of the face portion are adjacent the corner portions connected to the inner wall to which the face portion is contiguous, each piston having a pair of oppositely disposed side portions extending from the face portion thereof toward the central axis of the annular housing, each piston having an internal passage extending within the piston from a side portion to the face portion thereof, the internal passage being adapted to communicate with a chamber formed by the face portion of the piston to provide a flow path with respect thereto and being adapted to provide a combustion chamber within the piston into which the intake charge is compressed when the face portion of the piston is substantially contiguous with an inner wall of the annular housing;

(c) an end plate disposed at each of the opposite sides of the annular housing and extending substantially at right angles to the central axis of the housing for covering the side portions of the pistons adjacent the inner walls of the annular housing, the end plates in conjunction with the face portion of a piston and the corner portion of adjacent inner walls completing the chamber adapted to function as an intake chamber or an expansion chamber;

(d) means disposed within the annular housing and responsive to pressure of products of combustion in an expansion chamber for guiding each piston to rotate with respect to the central axis of the housing and to slide with respect to the inner walls of the housing with the end portions of the face portion of the piston being adjacent intersecting inner walls of the housing when the face portion of the piston is adjacent the corner therebetween and with the face portion of the piston being substantially contiguous with an inner wall of the housing when the end portions of the face portion are adjacent the corner portions of the inner wall to which the face portion is contiguous, the sliding of the piston with respect to the corner portion of intersecting adjacent inner walls sequentially forming the chambers between the piston and the intersection of adjacent inner walls, the guiding means enabling forces applied to a piston by the expanding of combustion products in an expansion chamber to rotate the pistons with respect to the central axis of the housing and to slide with respect to the inner walls of the housing;

(e) a shaft extending substantially along the central axis of the annular housing;

(f) means for connecting each sliding piston to the shaft with the pistons being spaced apart from one another;

(g) means for cyclically delivering a charge to the portion of the internal passage within a piston adjacent the side portion of the piston, the charge being adapted to pass through the internal passage of the piston and into the intake chamber formed between the face portion of the piston and the corner portion of intersecting adjacent inner walls of the annular housing; and (h) means for cyclically removing expanded products of combustion of the charge from the internal passage within the piston adjacent a side portion thereof, the expanded products of combustion thereby being removed from the expansion chamber formed between the face portion of the piston and the corner portion of intersecting adjacent inner walls of the housing.

2. A rotary internal combustion engine in accordance with claim 1 in which the annular housing has six inner walls intersecting at a common predetermined angle to one another and in which there are four sliding pistons.

3. A rotary internal combustion engine in accordance with claim 1 in which the annular housing has inner walls disposed with respect to one another substantially in the form of an ellipse the intake and expansion chambers being formed at the opposite ends of the ellipse.

4. A rotary internal combustion engine in accordance with claim 1 in which each corner portion of intersecting adjacent inner walls of the housing is rounded with a predetermined radius of curvature to control the volume of the chamber formed between the face portion of the piston and the corner portion of intersecting of adjacent inner walls.

5. A rotary internal combustion engine in accordance with claim 1 in which each of the plurality of sliding pistons has rounded end portions extending from the opposite ends of the length of the face portion, the rounded end portions being substantially tangential to the inner walls of the annular housing as the sliding piston rotates within the housing.

6. A rotary internal combustion engine in accordance with claim 5 in which each of the rounded end portions of a piston contains a seal, having portions contiguous with the inner wall of the annular housing adjacent thereto and substantially tangential with respect to the inner wall as the sliding piston rotates within the housing.

7. A rotary internal combustion engine in accordance with claim 6 in which the rounded end portions of the piston contain a lateral slot extending from one side portion of the piston to the other and in which the seal comprises a plurality of strips disposed in the slot substantially parallel and contiguous with one another, the strips extending in the slot between the side portions of the piston with an edge of each strip facing the inner wall of the annular housing adjacent thereto and adapted to be contiguous therewith.

8. A rotary internal combustion engine in accordance with claim 7 in which the strips are each segmented along their length in a direction extending between the side portions of the piston, the inner end portion of the length of each segmented strip being offset with respect to the inner end portions of the segmented strips adjacent thereto.

9. A rotary internal combustion engine in accordance with claim 7 and further comprising means for resiliently biasing the strips toward the inner wall of the annular housing adjacent thereto.

10. A rotary internal combustion engine in accordance with claim 1 in which each of the side portions of a piston have a seal extending along the length of the piston between the end portions thereof and adjacent the face portion thereof.

11. A rotary internal combustion engine in accordance with claim 10 in which the seal includes a slot extending with respect to each of the side portions of a piston and along the length of the piston adjacent the face portion thereof, each slot containing a strip having an outer edge portion adapted to be substantially contiguous with the end plate adjacent thereto.

12. A rotary internal combustion engine in accordance with claim 1 in which the face portion of a piston is in a predetermined form corresponding to one of a substantially flat surface extending along the length of the piston between the end portions thereof, a substantially concave surface extending along the length of the piston between the end portions thereof and a substantially convex surface extending along the length of the piston between the end portions thereof.

13. A rotary internal combustion engine in accordance with claim 2 in which the face portion of a piston is in the form of a substantially concave surface of predetermined profile extending along the length of the piston between the end portions thereof.

14. A rotary internal combustion engine in accordance with claim 13 in which each of the inner walls extending about the interior of the housing has a substantially convex surface extending between the corner portion between adjacent inner walls, the convex surface having a predetermined profile substantially corresponding to the predetermined profile of the face portion of the piston.

15. A rotary internal combustion enging in accordance with claim 1 in which each of the pistons has at least one recess in the face portion thereof substantially centrally disposed between end portions of the face portion of the piston, the recess being connected to the internal passage extending within the piston.

16. A rotary internal combustion engine in accordance with claim 1 in which the means disposed within the annular housing and responsive to pressure of products of combustion in an expansion chamber for guiding the pistons to rotate with respect to the central axis of the housing and to slide with respect to the inner walls of the housing with the end portions of the pistons being adjacent intersecting inner walls of the housing when the piston is adjacent thereto comprises;

(a) at least one cam extending circumferentially with respect to the central axis of the housing, the cam having a contoured portion adjacent each of the corner portions between intersecting adjacent inner walls of the annular housing; and (b) means mounted on each piston for coupling the piston to the cam to guide the piston to rotate with respect to the central axis of the housing and to slide with respect to the inner walls of the housing, the coupling means enabling the contoured portions of the cam to guide the piston to form a chamber with respect to the corner portion between intersecting adjacent inner walls.

17. A rotary internal combustion engine in accordance with claim 16 in which the means for coupling a piston to the cam comprises at least one follower mounted on the piston and adapted to engage the cam.

18. A rotary internal combustion engine in accordance with claim 17 in which there are a pair of cams, each of the cams being a plate cam extending substantially perpendicular to the central axis of the housing and adjacent a different side portion of each of the pistons and in which the follower comprises a follower element disposed on the side portion of the piston adjacent each of the opposite end portions of the piston.

19. A rotary fluid flow apparatus in accordance with claim 16 in which the cam comprises a pair of assemblies including a plate cam and a cam track disposed spaced apart from one another, each one of the pair being disposed adjacent a different side portion of each of the pistons, and in which the means for coupling the sliding piston to the cam comprises a pair of follower assemblies, each of the pair being disposed adjacent a different side portion of a piston and having a follower element adjacent each of the end portions of the piston for engaging one of the cam and cam track of a pair and another follower element disposed adjacent the central portion of the piston for engaging the other of the cam and cam track of the pair.

20. A rotary fluid engine in accordance with claim 19 in which the follower elements position the piston in one radial direction with respect to the drive shaft and the other follower element positions the piston in the opposite radial direction with respect to the drive shaft.

21. A rotary internal combustion engine in accordance with claim 17 in which there are a pair of cams, each of the cams being a plate cam extending substantially perpendicular to the central axis of the housing and disposed spaced apart from one another at a predetermined distance substantially in the central portion of the engine, and a pair of cam tracks extending substantially perpendicular to the central axis of the housing and disposed spaced apart from one another at another predetermined distance between the pair of plate cams; and in which the follower comprises pairs of follower elements in engagement with the cams, the pairs of follower elements being mounted on the inner side of the piston disposed opposite the face portion thereof each pair being mounted adjacent a different one of the opposite end portions of the piston, each pair of follower elements being disposed at a distance from one another corresponding to the predetermined distance between the plate cams, and a pair of additional follower elements in engagement with the cam tracks, the pair of additional follower elements being mounted on the inner side of the piston adjacent the central portion thereof, each of the pair of additional follower elements being disposed at a distance from one another corresponding to the other predetermined distance between the pair of cam tracks.

22. A rotary internal combustion engine in accordance with claim 1 in which the means for cyclically delivering a charge to the portion of the internal passage within a piston adjacent to the side portion of the piston comprises a port extending adjacent an end plate and adapted to be in alignment with the internal passage of the piston at the side portion thereof for delivering fluid to the internal passage, the port being disposed adjacent each of the corner portions of inner walls of the housing where a charge is to be delivered to the intake chamber formed by the piston, and in which the means for cyclically removing the products of combustion of a charge from the internal passage within the piston adjacent a side portion thereof comprises another port extending adjacent an end plate and adapted to be in alignment with the internal passage of the piston at the side portion thereof for removing the products of combustion from the open passage, the other port being disposed adjacent each of the corner portions of inner walls of the housing where the products of combustion are to be removed from the chamber formed by the piston.

23. A rotary internal combustion engine in accordance with claim 1 in which the means for connecting each sliding piston to the shaft with the pistons being spaced apart from one another comprises:

(a) a socket mounted on the drive shaft for each of the sliding pistons, each socket being spaced apart from the sockets adjacent thereto; and (b) a connecting rod for each of the sliding pistons, the connecting rod being pivotally attached to the sliding piston and slidably engaged with a different one of the sockets, the connecting rods transmitting the motion of the driven sliding pistons to the sockets and thereby to the drive shaft.

24. A rotary internal combustion engine in accordance with claim 1 and further comprising:

(a) a passage extending through the housing to adjacent the inner wall thereof, the passage intersecting an inner wall adjacent to which the trailing portion of an intake chamber is reduced by a sliding piston as the compression of the intake charge commences;

(b) means for delivering fluid through the passage to enhance the expansion of the products of combustion; and (c) means for controlling the means for delivering the fluid through the passage in synchronism with the rotation of the drive shaft.

25. A rotary internal combustion engine in accordance with claim 24 in which the means for delivering fluid through the passage comprises means for delivering pressured steam through the passage.

26. A rotary internal combustion engine in accordance with claim 1 in which the means for cyclically delivering a charge to the portion of the open passage within a piston includes means for metering fuel to the charge being delivered.

27. A rotary internal combustion engine in accordance with claim 1 and further comprising means for lubricating the sliding pistons, the elongated shaft and the means for coupling each sliding piston to the shaft.

28. A rotary internal combustion engine in accordance with claim 1 and further comprising means for transferring heat from at least a portion of the plurality of inner walls of the annular housing.

29. A rotary internal combustion engine in accordance with claim 1 in which:

(a) the means for cyclically delivering a charge comprises an intake manifold for delivering a charge to the portion of the open passage within a piston; and in which (b) the means for cyclically removing expanded products of combustion comprises an exhaust manifold for removing the expanded products of combustion of a charge from the open passage within the piston.

30. A rotary internal combustion engine in accordance with claim 1 and further comprising:

(a) means for igniting a charge compressed within the internal passage of each sliding piston; and (b) means for synchronizing the means for igniting the charge to the rotation of the drive shaft.

31. A rotary fluid flow apparatus in accordance with claim 1 in which at least one side portion of the piston contains a recess adjacent the open passage extending from the side portion of the piston to the face portion thereof and, a nipple disposed in the recess and having the interior thereof adapted to be connected to the open passage of the piston, one end portion of the nipple having an opening facing the inner surface of the end plate, and means for sealing the nipple with respect to the recess and for sliding contact of the opening along the end plate.

32. A rotary fluid flow apparatus in accordance with claim 29 in which the one end portion of the nipple having an opening facing the inner surface of the end plate extends beyond the side portion of the piston, a disc having the major plane thereof extending substantially at right angles to the central axis of the housing and having an opening therein for receiving the one end portion of each of the pipes, and means for sealing each of the openings of the disc to the respective nipples, the disc rotating within the housing with the sliding piston and preventing leakage from a chamber formed by a sliding piston.

33. A rotary fluid flow apparatus for deriving work by expanding pressured exhaust products of combustion from an engine delivering predetermined strokes for discharging products per cycle of the engine comprising;

(a) an annular housing having a plurality of inner walls extending about the interior of the housing and facing the central axis of the housing with the length of adjacent walls intersecting at a predetermined angle to one another to form a corner portion therebetween;

(b) a plurality of rotating sliding pistons each having a face portion with its length extending in the direction of the length of adjacent walls of the annular housing, the length of the face portion of the piston enabling the piston to be substantially contiguous at the end portions of the face portion to adjacent inner walls of the annular housing while the face portion forms a chamber with respect to the corner portion of adjacent inner walls, the chamber being adapted to function as one of an intake chamber for receiving an exhaust products charge and an expansion chamber in which the exhaust products charge is expanded, the face portion of the piston being substantially contiguous with an inner wall of the annular housing when the end portions of the face portion are adjacent the corner portions connected to the inner wall to which the face portion is contiguous, each piston having a pair of oppositely disposed side portions extending from the face portion thereof toward the central axis of the annular housing, each piston having an internal passage extending within the piston from a side portion to the face portion thereof, the internal passage being adapted to communicate with a chamber formed by the face portion of the piston to provide a flow path with respect thereto and being adapted to provide a chamber within the piston into which the intake charge is received when the face portion of the piston is substantially contiguous with an inner wall of the annular housing;

(c) an end plate disposed at each of the opposite sides of the annular housing and extending substantially at right angles to the central axis of the housing for covering the side portions of the pistons adjacent the inner walls of the annular housing, the end plates in conjunction with the face portion of a piston and the corner portion of adjacent inner walls completing the chamber adapted to function as an intake chamber or an expansion chamber;

(d) means disposed within the annular housing and responsive to pressure of the exhaust products charge in an expansion chamber for guiding each piston to rotate with respect to the central axis of the housing and to slide with respect to the inner walls of the housing with the end portions of the face portion of the piston being adjacent intersecting inner walls of the housing when the face portion of the piston is adjacent the corner therebetween and with the face portion of the piston being substantially contiguous with an inner wall of the housing when the end portions of the face portion are adjacent the corner portions of the inner wall to which the face portion is contiguous, the sliding of the piston with respect to the corner portion of intersecting adjacent inner walls sequentially forming the chambers between the piston and the intersection of adjacent inner walls, the guiding means enabling forces applied to a piston by the expanding of the exhaust products charge in an expansion chamber to rotate the pistons with respect to the central axis of the housing and to slide with respect to the inner walls of the housing;

(e) a shaft extending substantially along the central axis of the annular housing;

(f) means for connecting each sliding piston to the shaft with the pistons being spaced apart from one another;

(g) means adapted to be connected to an engine delivering predetermined strokes for discharging exhaust products for cyclically delivering a charge of exhaust products to the portion of the internal passage within a piston adjacent the side portion of the piston, the charge of exhaust products being adapted to pass through the internal passage of the piston and into the intake chamber formed between the face portion of the piston and the corner portion of intersecting adjacent inner walls of the annular housing;

(h) means for cyclically removing the expanded charge of exhaust products from the internal passage within the piston adjacent a side portion thereof, the expanded charge of exhaust products thereby being removed from the expansion chamber formed between the face portion of the piston and the corner portion of intersecting adjacent inner walls of the housing; and (i) means for coupling the shaft of the apparatus to the engine to synchronize the forming of expansion chambers in the apparatus to the predetermined strokes of the engine for discharging exhaust products therefrom.

34. A rotary fluid flow apparatus comprising:

(a) an annular housing having a plurality of inner walls extending about the interior of the housing and facing the central axis of the housing with the length of adjacent walls intersecting at a predetermined angle to one another to form a corner portion therebetween;

(b) a plurality of rotating sliding pistons each having a face portion with its length extending in the direction of the length of adjacent walls of the annular housing, the length of the face portion of the piston enabling the piston to be substantially contiguous at the end portions of the face portion to adjacent inner walls of the annular housing while the face portion forms a chamber with respect to the corner portion of adjacent inner walls, the chamber being adapted to function as one of an intake chamber for receiving an intake charge of fluid and an expansion chamber in which a charge of fluid is expanded, the face portion of the piston being substantially contiguous with an inner wall of the annular housing when the end portions of the face portion are adjacent the corner portions connected to the inner wall to which the face portion is contiguous, each piston having a pair of oppositely disposed side portions extending from the face portion thereof toward the central axis of the annular housing, each piston having an internal passage extending within the piston from a side portion to the face portion thereof, the internal passage being adapted to communicate with a chamber formed by the face portion of the piston to provide a flow path with respect thereto and being adapted to provide a chamber within the piston into which the intake charge is received when the face portion of the piston is substantially contiguous with an inner wall of the annular housing;

(c) an end plate disposed at each of the opposite sides of the annular housing and extending substantially at right angles to the central axis of the housing for covering the side portions of the pistons adjacent the inner walls of the annular housing, the end plates in conjunction with the face portion of a piston and the corner portion of adjacent inner walls completing the chamber adapted to function as an intake chamber or an expansion chamber;

(d) means disposed within the annular housing and responsive to pressure of a charge in an expansion chamber for guiding each piston to rotate with respect to the central axis of the housing and to slide with respect to the inner walls of the housing with the end portions of the face portion of the piston being adjacent intersecting inner walls of the housing when the face portion of the piston is adjacent the corner therebetween and with the face portion of the piston being substantially contiguous with an inner wall of the housing when the end portions of the face portion are adjacent the corner portions of the inner wall to which the face portion is contiguous, the sliding of the piston with respect to the corner portion of intersecting adjacent inner walls sequentially forming the chambers between the piston and the intersection of adjacent inner walls, the guiding means enabling forces applied to a piston by the expanding of a charge in an expansion chamber to rotate the pistons with respect to the central axis of the housing and to slide with respect to the inner walls of the housing;

(e) a shaft extending substantially along the central axis of the annular housing;

(f) means for connecting each sliding piston to the shaft with the pistons being spaced apart from one another;

(g) means for cyclically delivering a charge to the portion of the internal passage within a piston adjacent the side portion of the piston, the charge being adapted to pass through the internal passage of the piston and into the intake chamber formed between the face portion of the piston and the corner portion of intersecting adjacent inner walls of the annular housing; and (h) means for cyclically removing an expanded charge from the internal passage within the piston adjacent a side portion thereof, the expanded charge thereby being removed from the expansion chamber formed between the face portion of the piston and the corner portion of intersecting adjacent inner walls of the housing.

* * * * *